US005761747A

United States Patent [19]

Eagleson

[11] Patent Number: 5,761,747

[45] Date of Patent: Jun. 9, 1998

[54] LONG JOHNS HAVING ELASTIC LEG OPENING WELTS

[76] Inventor: Lawrence J. Eagleson, P.O. Box 331, Olney, Ill. 62450

[21] Appl. No.: 881,224

[22] Filed: Jun. 24, 1997

[51] Int. Cl.[6] ..... A41B 9/00

[52] U.S. Cl. ..... 2/400; 2/227

[58] Field of Search ..... 2/69, 73, 78.1–78.3, 2/79, 227, 400, 401, 403, 404, 407

[56] References Cited

U.S. PATENT DOCUMENTS 2,242,526 5/1941 Kneibler ..... 2/404

4,089,064 5/1978 Chandler ..... 2/78.3

*Primary Examiner*—Gloria M. Hale

[57] ABSTRACT

This invention is long john underwear made for those persons who usually wear supportive type shorts. The undergarment snugs the tops of oversize long john leg covers to the hip joints of the wearer, thus each leg cover has an additional hold. The oversize leg covers permit the upward seating of the hip cover panel and the fly/crotch panel. The leg covers, hip cover and fly/crotch are relaxed non-resilient panels that are held in place by resilient waistband, elastic leg opening welts and ankle cuffs. The tops of the leg cover panels are separated by the crotch of the fly/crotch panel and seat of the hip cover panel.

1 Claim, 4 Drawing Sheets

LONG JOHNS HAVING ELASTIC LEG OPENING WELTS

BACKGROUND OF INVENTION

This invention is long underwear which is suitable for persons who usually wear supportive type shorts. The invention is related to long john types of undergarments that have full length leg covers. The supportive fly/crotch panel and seat portion of the hip cover panel separate the upper terminus of each leg covering panel. The leg portions are comprised of relaxed leg elements which allow upward placement and eliminate downward creep of the undergarment. The leg elements are as indicated, loose fitting leg coverings with ankle cuffs at the lower terminus. The invention is long johns that have two extra elastic bands that snug the overlap of relaxed panels to the hip joints. This construction keeps oversized leg covers up and provides a supportive type fit.

BRIEF DESCRIPTION OF THE PRIOR ART

| INVENTOR | DATE | PAT. NO. | DESCRIPTION |
|---|---|---|---|
| Berry | 1968 | Des.211,313 | Panty Hose |
| Chandler, Jr. | 1978 | 4,089,064 | Protective Athletic Pants Hose |
| Brown | 1987 | 4,669,130 | Garment Construction |
| Staley | 1989 | 4,870,708 | Undergarment |
| Brisco | 1992 | 5,136,727 | Exercise Shorts |
| Kneibler | 1941 | 2,242,526 | Undergarment |

SUMMARY OF INVENTION

The invention does encompass the hip; it defines the waist with an elastic waistband. The invention comprises seamed together panels that extend downward from waistband to ankle encompassing cuffs that define the bottom of each leg cover. The invention's seamed together panels extend into and form a crotch. The fly/crotch panel is of one panel with two thicknesses of fabric. The hip cover panel is of one panel with one thickness of fabric. The two leg covering panels are of one thickness of fabric and overlap the hip cover panel and fly/crotch panel.

The fly portion of the fly/crotch panel is seamed between the two front vertical edges of the hip covering panel. The fly portion of the fly/crotch panel tapers to become the crotch portion of the fly/crotch panel. The crotch portion of the fly/crotch panel is defined by two opposite curved edges. The seat area of the hip cover panel is defined by divergent slant edges. These slant edges turn to curved edges wrapping around the sides of the hip to the front fly portion of the fly/crotch panel. The seat area of the hip covering panel and the crotch portion of the fly/crotch panel are connected by the seat seam. The curved edges of the fly/crotch panel and slant curved edges of the hip cover panel form two slant curved leg opening edges within the aforesaid panel edges. The slant curved leg opening edges of oversize leg covering panels match and overlap the slant curved leg opening edges of the fly/crotch panel and hip cover panel. The hip cover and fly/crotch panels are relaxed, non-resilient supportive panels.

The invention combines supportive panels and oversize leg covering panels in a single undergarment. The invention's top plan view is of long johns with a continuous hip cover panel wrapped around hip to the fly/crotch panel. The leg opening portions of the supportive panels are seamed to the inside of the leg opening portions of the oversize leg covering panels. The invention has continuous elastic welts that cause overlapped leg opening portions of the panels to fit closely into the hip joints all around the wearer's hip joints; front groins, side hip sockets, back gluteal folds and junctures of crotch and thighs, thus holding the oversize long john leg covers up and the supportive panels in place. An elastic welt is seamed to the edge of each leg opening portion of the supportive panels which are underneath the leg opening portions of the leg covering panels. The leg openings of the leg cover panels are finished by the seams attaching the leg cover panels to the supportive panels. The supportive panel's leg openings are finished by the elastic welts. Between the finished leg opening of the leg cover panel and finished leg opening of the supportive panel is a margin of fabric, a flange, that permits the unhampered function of the elastic welt.

The invention's hip cover panel covers ⅚th of the hip area, wrapping around to the fly/crotch panel which covers ⅙th of the hip area. The end portions of the hip cover panel and fly/crotch panel cover the pelvis. There is a tape between the fly/portion of the fly/crotch panel and each end portion of the hip cover panel. The fly/crotch panel has a vertical overlap. The invention's fly/crotch panel extends back beyond the perineum area squared thereof with the seat portion of the hip cover. The invention's fly/crotch panel insulates the pelvis.

The invention's oversize leg coverings allow the natural seating of the supportive panels. The invention's leg coverings hang loose from the supportive panels down to the ankle covering cuffs. Each leg covering has a seam, connecting long edges of the panel, that runs perpendicularly up the inside of each ankle cuff and leg cover panel to attach to the fly/crotch panel. The invention insulates the covered legs with relaxed materials and has elastic welts. The back sides of the leg cover panels are seamed above the slant leg opening edges of the supportive panels. The inside, front side and outside of the leg cover panels are seamed above the curved leg opening edges of the supportive panels. The invention's oversize leg covers are separate and are seamed over and above separate supportive panel leg opening portions. The invention's leg coverings are separated by the fly/crotch panel and seat portion of the hip cover panel. The invention's leg covering panels are non-constricting.

The invention's relaxed panels are made of cotton or wool or a combination thereof. The invention's relaxed panels are made of non-resilient knit fabric; a knit fabric that stretches out but does not rebound. The inventions fabric loosely conforms to the wearer's shape, allowing air spaces between the wearer and relaxed coverings. This invention thus holds heat in during a cold environment. The invention is made to wear under an outer garment. The waistband, welts and ankle cuffs are resilient and fit snug. The invention's knit fabric has ease.

The invention is of long john underwear, with elastic welts attached to the supportive panel leg opening edges that are overlapped by leg opening portions of oversize long john leg covers. The object of the invention is to make long john underwear that are suitable for persons who usually wear briefs.

DESCRIPTION OF PREFERRED EMBODIMENT

For a pair of long johns 10 with a waist, the waistband 20 is woven of elastic made of 70% polyester and 30% elastomer, heat resistant rubber, the waistband 20 yields a 120% stretch. The waistband 20 is closed and tacked with a superimposed class seam, SSa-1, general seaming, using a #301 lockstitch with #100 spun polyester thread.

Figure 2:
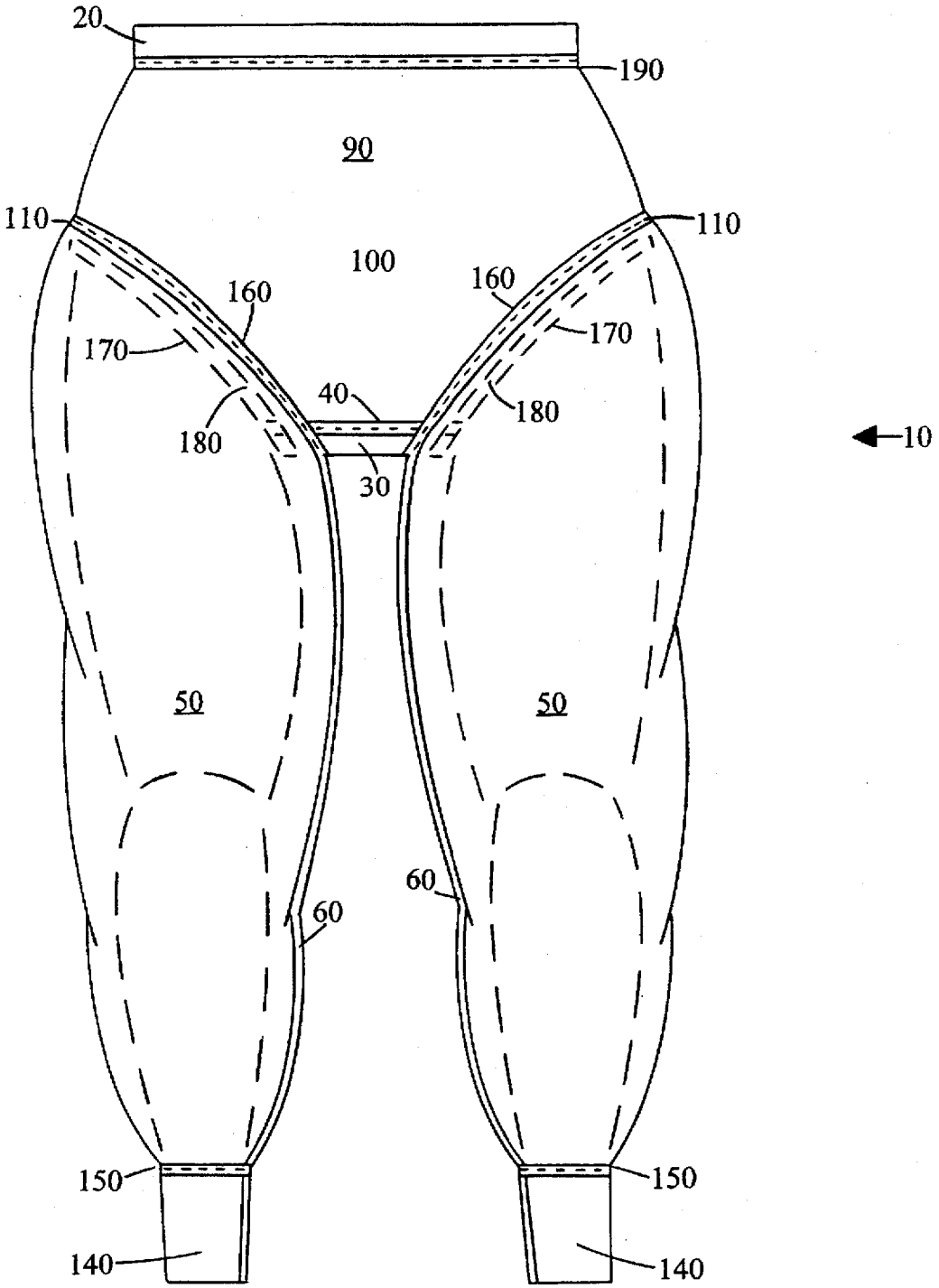
FIG. 2 is a rear view of the FIG. 1 invention.

The fly/crotch panel 30 is two layers of 1×1 rib knit fabric made of #25 single cotton count yarn. The fly/crotch panel 30 is an elongated hexagonal shape, widest across the upper middle, tapering to the waist at the top and to the seat seam 40 FIG. 2 FIG. 4 at the back and being narrowest extending across the tops of the inseams 60.

Figure 1:
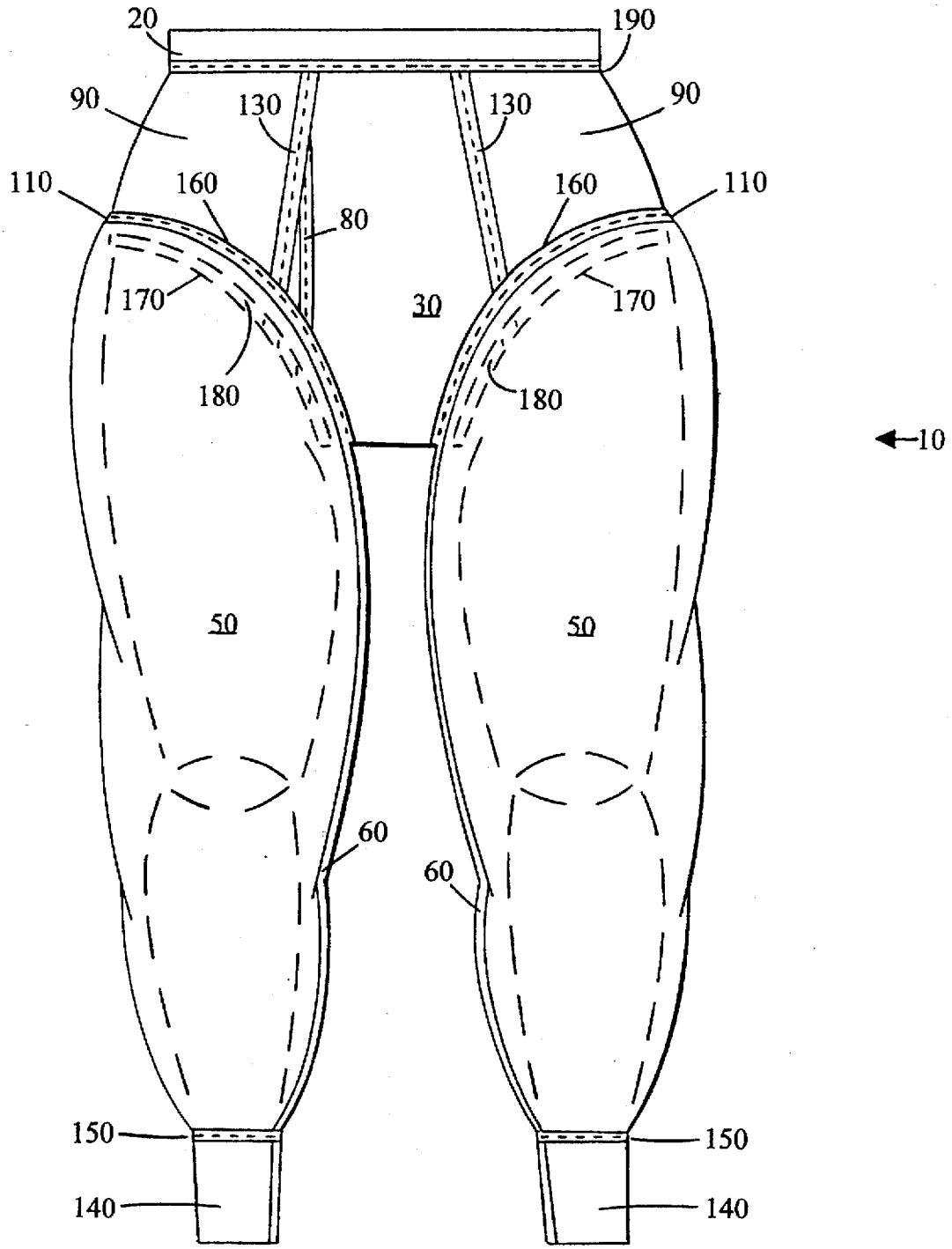
FIG. 1 is a front view of the invention.
Figure 3:
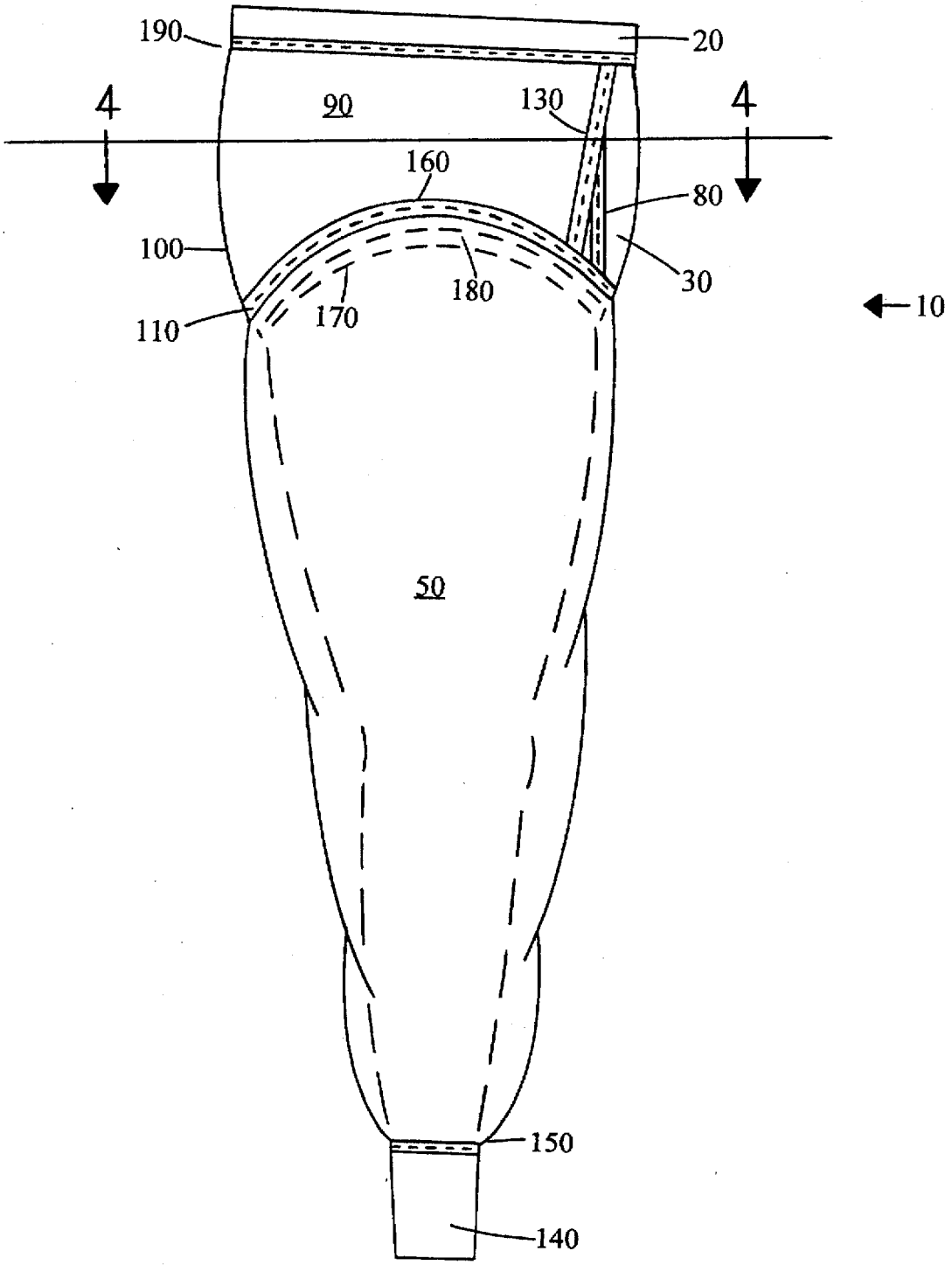
FIG. 3 is a view in side elevation of the FIGS. 1 and 2 invention.
Figure 4:
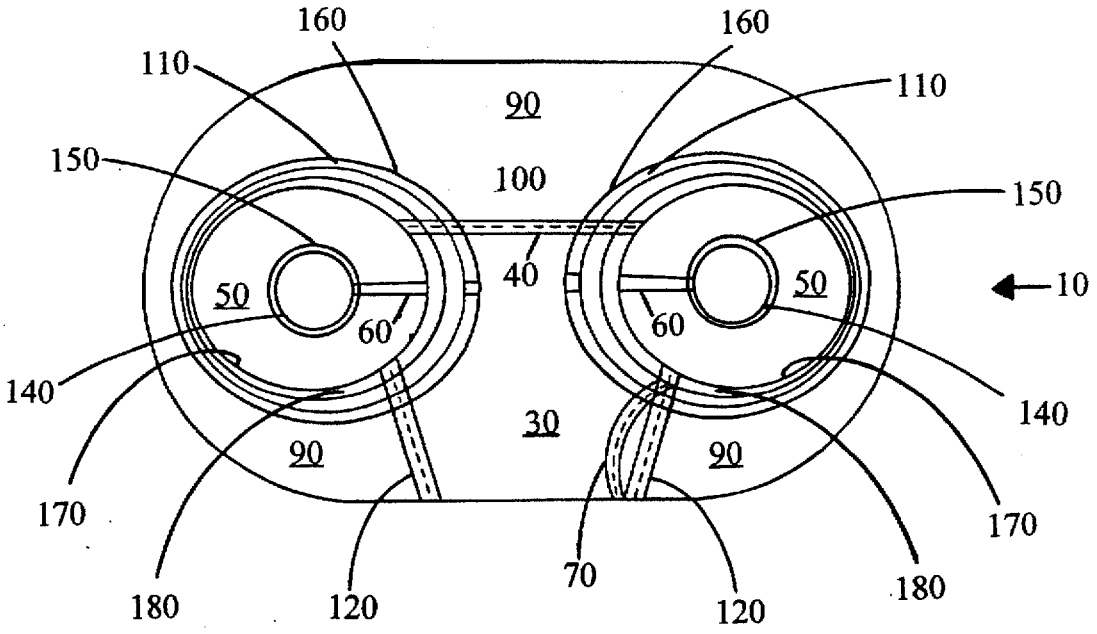
FIG. 4 is a section view of the invention of FIGS., 1, 2 and 3 taken along the lines 4—4 thereof

The left fly binding 70 FIG. 4 and right fly binding 80 FIG. 1 and 3 are made with a bound class seam, BSb-1, using a #406 double lockstitch with #200 textured polyester thread.

The hip cover panel 90 is 1×1 cotton rib knit, made from #25 single cotton count yarn. The hip cover panel 90 is transversely long, wide at hip cover seat portion 100, between waistband 20 and seat seam 40 narrowing to the front portions. The hip cover panel 90 and the fly/crotch panel 30 are lapped seamed 110 to oversize leg covers 50. A hip cover panel 90 and fly/crotch panel 30 leg opening terminates inside each oversize leg cover 50, at a little distance below lapped seams 110.

The hip cover panel 90 and fly portion of fly/crotch panel 30 are joined with a, SSa-1, general seaming, superimposed class seam 120 FIG. 4, using a 504-3 thread overedge stitch with #200 textured polyester thread.

The front of the hip cover panel 90 and fly portion of fly/crotch panel 30 seams 120 are taped 130 with folded rib cotton tape. This tape 130 is sewn over the front of seam 120, FIG. 4 with a lapped class seam, LSZ-3 seam using a #401 chain stitch with #200 textured polyester thread. The seat seam 40 connecting back portion of fly/crotch panel 30 and seat portion 100 of hip cover panel 90 is a flat class seam FSa, using a #607 cover stitch with #200 textured polyester thread.

The oversize long john leg coverings 50 are of 1×1 cotton knit fabric made from #25 single cotton count yarn. The ankle cuffs 140 are 1×1 cotton rib knit fabric, with a 5% elastomer, folded double and sewn to the longer bottom edge 150 of leg covering 50, with a lapped class seam, LSa-1, using a #605 cover stitch with #200 textured polyester thread. With each stitch there is a minute shirring of leg covering 50 bottom edge material 150 to cuff 140 that allows the leg covering 50 to fit loose and the ankle cuff 140 to fit snug. The inseam 60 of the leg covering panel 50 and ankle cuff 140 is a flat class seam, FSa, using a #607 cover stitch with a #200 textured polyester thread.

The circumference of the upper edge 160 of the leg covering 50 is longer than the circumference at a little distance above the leg opening edge 170 of hip cover 90 fly/crotch panel 30. The upper edge 160 of the leg covering 50 is lap seamed, LSa-1 110 to the outside of the hip cover 90 fly/crotch panel 30 at a little distance above the leg opening edge 170 of the hip cover 90 panel fly/crotch panel 30. A minute shirring of upper edge 160 of leg covering 50 material during seaming of upper edge 160 of leg covering 50 to hip cover panel 90 fly/crotch panel 30 makes the circumferences the same length, keeping attached leg covers 50 fuller and looser than leg openings of hip cover 90 fly/crotch 30 panels using a #607 flat covering stitch with #200 textured polyester thread.

The hip cover panel 90 fly/crotch panel 30 leg opening edges 170 are bound with a tape of 1×1 cotton rib knit folded to encase a rubber strip elastic band with a minimum of 600% stretch, 60% stretch encased. The non-strip encasing side of the tape is folded over the hip cover panel 90 fly/crotch panel 30 leg opening edge to the outside of the aforesaid leg opening edge 170 (shown in phantom, bottom role of broken lines, FIG. 1, FIG. 2, FIG. 3.) The tape and elastic strip are seamed to the leg opening edge 170 forming an elastic welt 180 (shown in phantom, double role of broken lines, FIG. 1, FIG. 2, FIG. 3) using a bound class seam BSb-1, with a #406 chain stitch with #200 textured polyester thread. The edge 170 of the hip cover panel 90 fly/crotch panel 30 leg opening is longer than the elastic welt 180. A minute shirrng of material during binding of the leg opening reduces this length to the same length as the aforesaid elastic welt 180. This minute shirring gives the supportive panels ease, a loose fit, while the elastic welt 180 itself fits snug.

The waistband 20 is attached to waist of hip cover panel 90 and fly/crotch panel 30 with a lapped class seam, LSa-1, using a #407 lockstitch with #100 spun polyester thread. With each stitch there is a minute shirring of hip cover 90 and fly/crotch 30 material when seaming these panels to waistband 20. This minute shirring of hip cover panel 90 and fly/crotch panel 30 edge 190 allows ease in the panels and snug fit at the waistband 20.

Many modifications and variations of this invention are possible in light of the above teachings. I therefore intend thie above terminology to describe illustratively the invention's prefeffed embodiment and not to limit its scope. Within the scope of the appended claims one may practice the invention other than as the above specification describes.

The scope of the invention is thus defined in the following claims, wherein: I claim:

1. Long john underwear comprising a resilient waistband, a hip cover panel and a fly/crotch panel attached thereto and legs having an ankle band attached at one end and an upper leg opening edge at an upper end thereof; said fly/crotch panel and said hip cover having edges; said fly/crotch panel edges and hip cover edges attached to said leg openings with elastic welts attached therebetween said fly/crotch panel, hip cover and said upper leg opening edges whereby said elastic welt provides a snug fit around the wearer's hip joint.

* * * * *